US009196944B2

(12) United States Patent
Mohan et al.

(10) Patent No.: US 9,196,944 B2
(45) Date of Patent: Nov. 24, 2015

(54) APPARATUS FOR COMBINING HIGH FREQUENCY ELECTRICAL ENERGY FROM A PLURALITY OF SOURCES

(75) Inventors: Ankush Mohan, Folsom, CA (US); Yehuda Goren, Scotts Valley, CA (US); William Goumas, Rancho Cordova, CA (US)

(73) Assignee: Teledyne Wireless, LLC, Thousand Oaks, CA (US)

( * ) Notice: Subject to any disclaimer, the term of this patent is extended or adjusted under 35 U.S.C. 154(b) by 360 days.

(21) Appl. No.: 13/567,398

(22) Filed: Aug. 6, 2012

(65) Prior Publication Data

US 2014/0035697 A1 Feb. 6, 2014

(51) Int. Cl.
*H01P 5/12* (2006.01)
*H01P 5/08* (2006.01)

(52) U.S. Cl.
CPC .. *H01P 5/12* (2013.01); *H01P 5/085* (2013.01)

(58) Field of Classification Search
USPC ..... 333/124–129, 132, 134, 136, 137
See application file for complete search history.

(56) References Cited

U.S. PATENT DOCUMENTS 4,686,494 A * 8/1987 Kaneko et al. ..... 333/137

* cited by examiner

*Primary Examiner* — Robert Pascal
*Assistant Examiner* — Kimberly Glenn
(74) *Attorney, Agent, or Firm* — K&L Gates LLP

(57) ABSTRACT

A broadband building block portion is provided, which may be used to construct N-way multi-port combiners. The building block portion comprises a first feeding probe that receives a first input signal, a second feeding probe that receives a second input signal, a combining probe that combines the first and second input signals to output a combined signal, and a transmission line coupled to the first and second feeding probes.

22 Claims, 10 Drawing Sheets

APPARATUS FOR COMBINING HIGH FREQUENCY ELECTRICAL ENERGY FROM A PLURALITY OF SOURCES

FIELD OF THE DISCLOSURE

The present disclosure relates to devices that combine high frequency electrical energy from a plurality of sources. More particularly, the present disclosure relates to high power, broadband, compact, low loss, scalable combiners.

BACKGROUND OF THE DISCLOSURE

Conventional semiconductor-based, micro-strip and waveguide combiners have been used to generate, e.g., microwave power by combining the outputs of a plurality of energy sources. With small scale or size, and high reliability characteristics, micro-strip-based combiners have been used to combine a plurality of low power signals to output a high power signal. Similarly, interchangeable transmission lines have been used in, e.g., tree configurations, to combine a plurality of low power signals to output a high power signal.

Micro-strip-based combiners, for example, which tend to be the most common combiners, suffer from high combining losses, especially in the millimeter-wave frequencies, and limited power handling, and, as a result, are limited with the number of resources that can be combined.

Waveguide combiners can handle significantly higher power than semiconductor-based combiners. However, waveguide combiners frequently can become too large, too heavy and too expensive, especially at low microwave frequencies. While there is no limit to the number of energy source outputs that may be combined in waveguide combiners, the size, weight, and cost of the waveguide combiner goes up with the number of energy source outputs. They can also have bandwidth limitations.

Recently, new techniques of quasi-optical and spatial power combiners have been used in waveguides and coaxial forms of combiners. Rectangular waveguide spatial combiners can handle high power microwave levels, but these combiners suffer from limited bandwidth, as well as from a limited number of combined transistors (especially in the millimeter-wave frequencies), and from non-uniform illumination of a loaded finline array inside the waveguide. Coaxial spatial combiners have the bandwidth capability, but these combiners tend to have complex constructions that are difficult to fabricate and, therefore, may not be applicable for millimeter-wave applications. Moreover, it is almost impossible to remove heat efficiently from the loaded finline array.

The present disclosure provides a compact, buildable, substantially planar, solid-state, high power, wideband, low-loss combiner that has superior thermal management.

SUMMARY OF THE DISCLOSURE

The present disclosure provides a plurality of examples of multi-port combiners that include one or more interchangeable low-loss transmission lines (such as, e.g., rectangular waveguides, double-ridge waveguides, rectangular coaxial strip-lines, or the like) that may operate as short cavities loaded with, e.g., coaxial probes. According to the principles of the disclosure, a multi-port combiner may be constructed to have any number of input ports by building the multi-port combiner from one or more two-way combiner blocks, as disclosed herein.

According to an aspect of the disclosure, a broadband building block portion (or cell) is provided, which may be used to construct N-way multi-port combiners. The building block portion comprises: a first feeding probe that receives a first input signal; a second feeding probe that receives a second input signal; a combining probe that combines the first and second input signals to output a combined signal; and a transmission line coupled to the first and second feeding probes.

The transmission line may comprise a terminated transmission line with the first feeding probe at one end and the second feeding probe at another end.

The combining probe may be located substantially at a center of the terminated transmission line.

The transmission line may be selected from a group comprising: a rectangular waveguide; a double-ridged terminated waveguide; a strip-line transmission line; a coaxial transmission line; a micro-strip transmission line; or a single-wire transmission line.

The rectangular waveguide may be selected from a group consisting of: a WR-1 waveguide; a WR-1.5 waveguide; a WR-2 waveguide; a WR-3 waveguide; a WR-4 waveguide; a WR-5 waveguide; a WR-6 waveguide; a WR-8 waveguide; a WR-10 waveguide; a WR-12 waveguide; a WR-15 waveguide; a WR-19 waveguide; a WR-22 waveguide; a WR-28 waveguide; a WR-42 waveguide; a WR-51 waveguide; a WR-62 waveguide; a WR-90 waveguide; a WR-112 waveguide; and a WR-137 waveguide.

According to a further aspect of the disclosure, a multi-port combiner is provided that may be constructed from one or more building block portions. The multi-port combiner may comprise: a third feeding probe that receives a third input signal; a fourth feeding probe that receives a fourth input signal; an other combining probe that combines the third and fourth input signals to output an other combined signal; and an other transmission line coupled to the third and fourth feeding probes. The other transmission line may comprise a terminated transmission line with the third feeding probe at one end and the fourth feeding probe at another end.

The multi-port combiner may further comprise an output terminal that outputs a combiner signal, wherein the combiner signal comprises said combined signal and said other combined signal.

According to a still further aspect of the disclosure, a planar combiner is provided that comprises: a plurality of feeding probes that receive a plurality of input signals; a combining probe that combines the plurality of input signals; and a transmission line that carries the plurality of input signals between the plurality of feeding probes and the combining probe.

The transmission line may comprise a terminated transmission line with a feeding probe on each end.

The transmission line may be selected from a group comprising: a rectangular waveguide; a double-ridged terminated waveguide; a strip-line transmission line; a coaxial transmission line; a micro-strip waveguide; or a single-wire transmission line. The rectangular waveguide may be selected from a group consisting of: a WR-1 waveguide; a WR-1.5 waveguide; a WR-2 waveguide; a WR-3 waveguide; a WR-4 waveguide; a WR-5 waveguide; a WR-6 waveguide; a WR-8 waveguide; a WR-10 waveguide; a WR-12 waveguide; a WR-15 waveguide; a WR-19 waveguide; a WR-22 waveguide; a WR-28 waveguide; a WR-42 waveguide; a WR-51 waveguide; a WR-62 waveguide; a WR-90 waveguide; a WR-112 waveguide; and a WR-137 waveguide.

The combiner may further comprise an output terminal that outputs a combined signal, which comprises the plurality of input signals.

The combiner may further comprise a plurality of input terminals connected to the plurality of feeding probes, wherein the plurality of input terminals are configured to receive the plurality of input signals from one or more signal sources.

The plurality of feeding probes may comprise two feeding probes.

The output terminal may be connected to the combining probe.

The combiner may further comprise another combining probe that combines another plurality of input signals; and/or another transmission line coupled to the combining probe and said other combining probe.

The combiner may further comprise a layer that includes a plurality of through-holes, wherein at least a portion of each of the plurality of feeding probes extends into or through a portion of the layer.

The combiner may further comprise an other layer formed proximate to said layer, wherein at least a portion of the combining probe extends into or through a portion of said other layer, and wherein at least a portion of the transmission line is located between said layer and said other layer.

The combiner may further comprise a further transmission line coupled between a pair of feeding probes, wherein the plurality of probes comprise said pair of feeding probes.

The combiner may further comprise a further combining probe that is coupled to said other transmission line.

Additional features, advantages, and embodiments of the disclosure may be set forth or apparent from consideration of the detailed description and drawings. Moreover, it is to be understood that the foregoing summary of the disclosure and the following detailed description and drawings are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

Figure 1B:
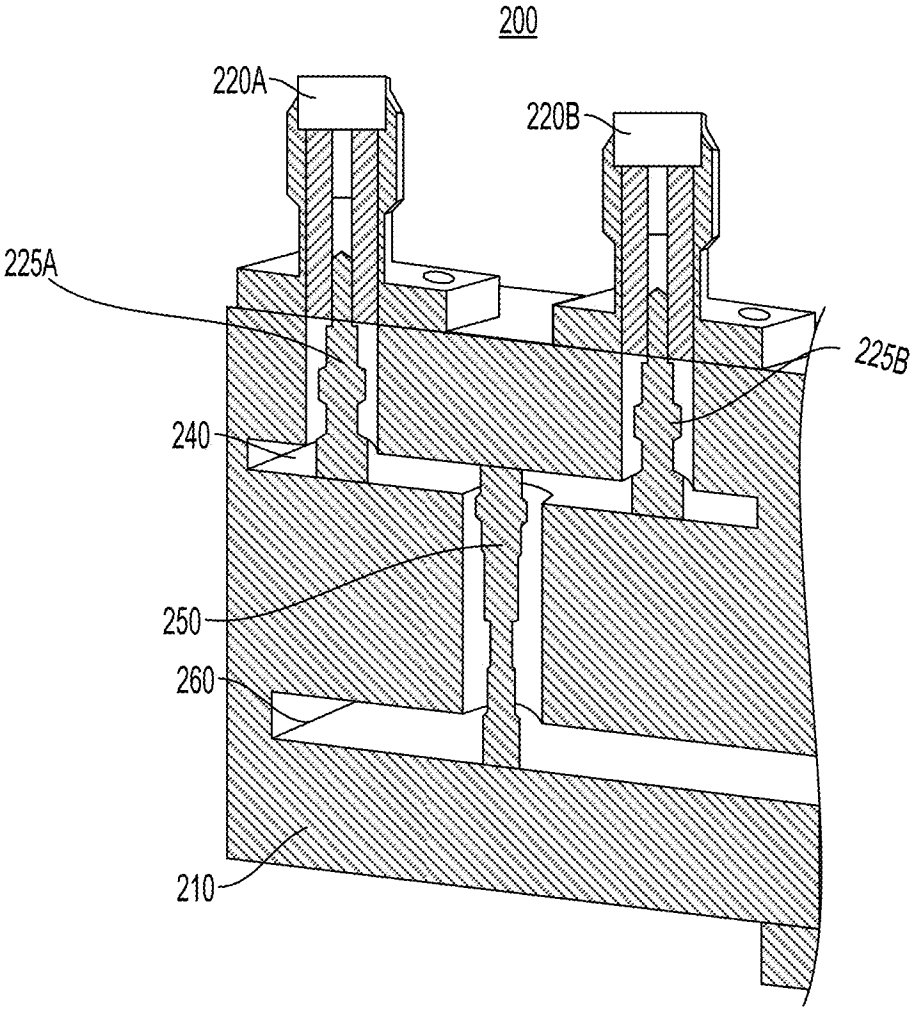
FIG. 1B shows an example of a combiner that includes a rectangular waveguide, which is constructed according to the principles of the disclosure.

The present disclosure is further described in the detailed description that follows.

DETAILED DESCRIPTION OF THE DISCLOSURE

The disclosure and the various features and advantageous details thereof are explained more fully with reference to the non-limiting embodiments and examples that are described and/or illustrated in the accompanying drawings and detailed in the following description. It should be noted that the features illustrated in the drawings and attachment are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

The terms "including," "comprising," and variations thereof, as used in this disclosure, mean "including, but not limited to," unless expressly specified otherwise.

The terms "a," "an," and "the," as used in this disclosure, mean "one or more," unless expressly specified otherwise.

Devices that are in communication with each other need not be in continuous communication with each other, unless expressly specified otherwise. In addition, devices that are in communication with each other may communicate directly or indirectly through one or more intermediaries.

Although process steps, method steps, algorithms, or the like, may be described in a sequential order, such processes, methods and algorithms may be configured to work in alternate orders. In other words, any sequence or order of steps that may be described does not necessarily indicate a requirement that the steps be performed in that order. The steps of the processes, methods or algorithms described herein may be performed in any order practical. Further, some steps may be performed simultaneously.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device may be alternatively embodied by one or more other devices which are not explicitly described as having such functionality or features.

Figure 1A:
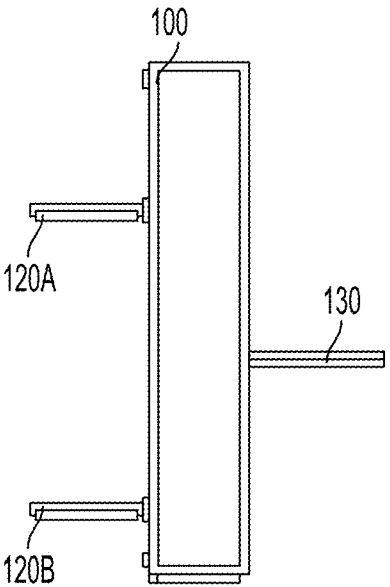
FIG. 1A shows a representation of a basic two-way combiner that is constructed according to the principles of the disclosure.

FIG. 1A shows a representation of a basic two-way combiner 100 that is constructed according to the principles of the disclosure. The combiner 100 may serve as a building block for an N-way combiner, i.e., N:1 combiner (N inputs, one output), where N is an even positive integer greater than, or equal to 2 (e.g., 2, 4, 6, 8, . . . ). The combiner 100 includes a pair of inputs 120A, 120B, and an output 130.

FIG. 1B shows a partial view of an N-way combiner, which shows a basic building block portion (or cell) 200 of the N-way combiner, constructed according to the principles of the disclosure. The N-way combiner, which includes the building block portion 200, includes a body 210, a pair of inputs 220A, 220B, a pair of feeding probes 225A, 225B, a transmission line 240, a combiner probe 250, and an output. The building block portion 200 may be used as a basic building block in constructing an N:1 multi-port combiner. For example, one or more building block portions 200 may be configured into a single structure to construct a multi-port (N-port) combiner that may receive and combine N input signals and output a single (or more than one) output combined signal.

The N-way combiner in FIG. 1B may include additional feeding probes (not shown), one or more additional combiner probes (not shown), and one or more additional transmission lines 260. Accordingly, the N-way combiner may be constructed from a plurality of the building block portions 200. Each building block portion 200 may comprise, e.g., a terminated transmission line with a feeding probe on each of its two ends and a combining probe positioned at its center. This structure may be repeated to construct the N-way combiner.

The building block portion 200 may have a substantially planar configuration that provides low loss, wideband, and thermally managed operation. The building block portion 240 may have a high Q resonator value, where the probe 250 may be loaded with Q values such that the external Q value of the combiner 240 is close to unity.

The inputs 220A, 220B may include connecters, such as, for example, 50Q coaxial connectors. The feeding probes 225A, 225B may include, for example, coaxial probes. The dimensions of each of the feeding probes 225A, 225B, and the distance from a wall of the transmission line 240 may be optimized to obtain a desired frequency bandwidth and a desired input reflection coefficient value for each of the inputs 220A, 220B, as one of ordinary skill in the art will recognize. The inner cavity dimensions of the transmission line 240 and the feeding probe placement in the combiner may be optimized to obtain minimal input reflection coefficient and uniform power division. For example, the probes 225A, 225B may be symmetrically located with respect to the transmission line 240 to provide symmetrical field disturbances and distribution, thereby providing optimal power transfer between the probe 250 and the probes 225A, 225B.

The building block portion 200 provides a basic building block that may be integrated into a device with many (e.g., 4, 6, 8, or more) input ports that has minimal signal splitting and combining losses.

Figure 2A:
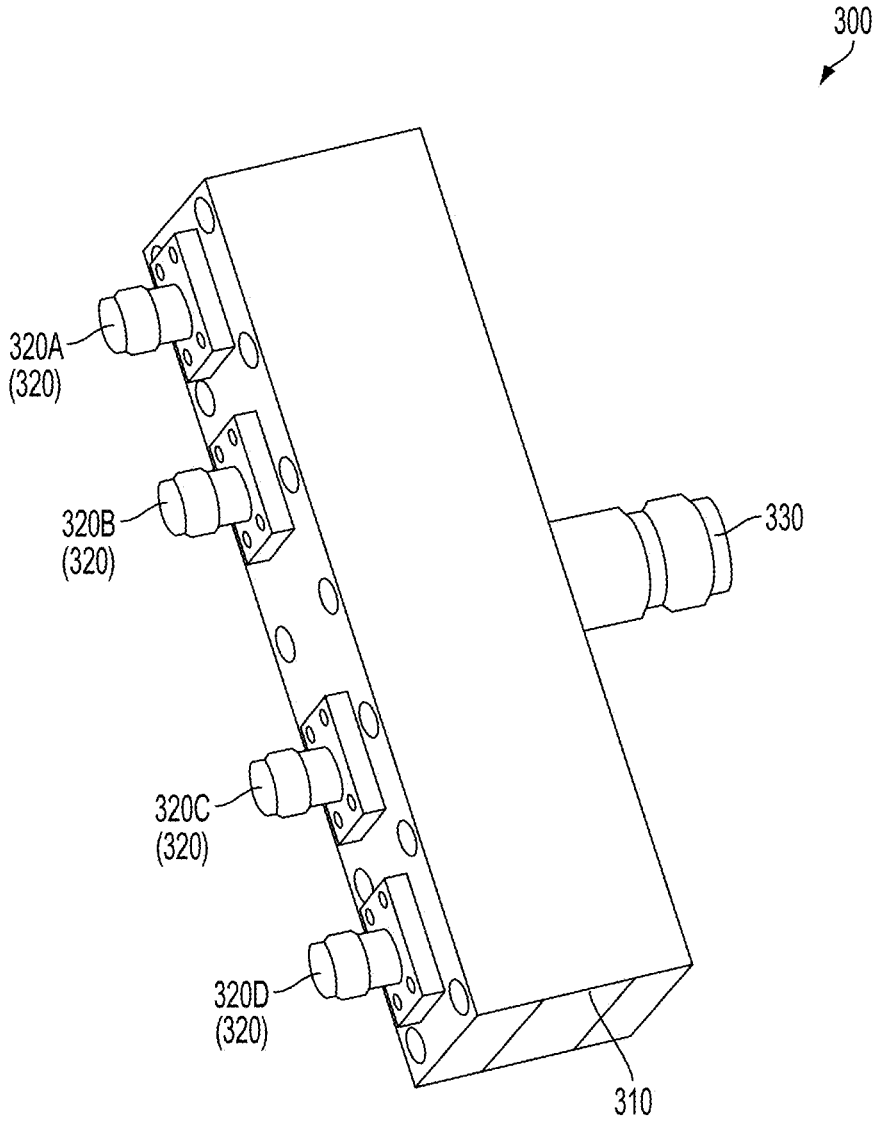
FIG. 2A shows an example of a multi-port combiner that is constructed according to the principles of the disclosure.

FIG. 2A shows an example of a 4-way multi-port (4:1) combiner 300 that is constructed according to the principles of the disclosure. The combiner 300 may be constructed by combining two building block portions 200 (shown in FIG. 1B).

The combiner 300 includes a body 310, a plurality of inputs 320A, 320B, 320C, 320D (individually or collectively referred to as 320), and an output 330. The inputs 320 may include, e.g., four sub-miniaturized version A (SMA) coaxial R7 connectors. The output 330 may include, e.g., a threaded Neill-Concelman (TNC) connector. The inputs 320 may be configured to receive a plurality signals (e.g., four X-band signals) from one or more power sources (not shown). The combiner 300 may combine the plurality of received signals to output a single combined signal. The body 310 may be configured to have a length of, e.g., about 3.5 inches, a height of, e.g., about 1.25 inches, and a width of, e.g., about 0.9 inches. The body 310 may have larger or smaller length-height-width dimensions.

According to an embodiment of the disclosure, the combiner 300 may have, e.g., about 40% bandwidth with a combining of loss of, e.g., less than about 0.2 dB and a power handling of, e.g., over 100 W CW where the inputs 320 include SMA connectors (or, e.g., over 500 W CW where the inputs 320 include TNC or Type N connectors).

Figure 2B:
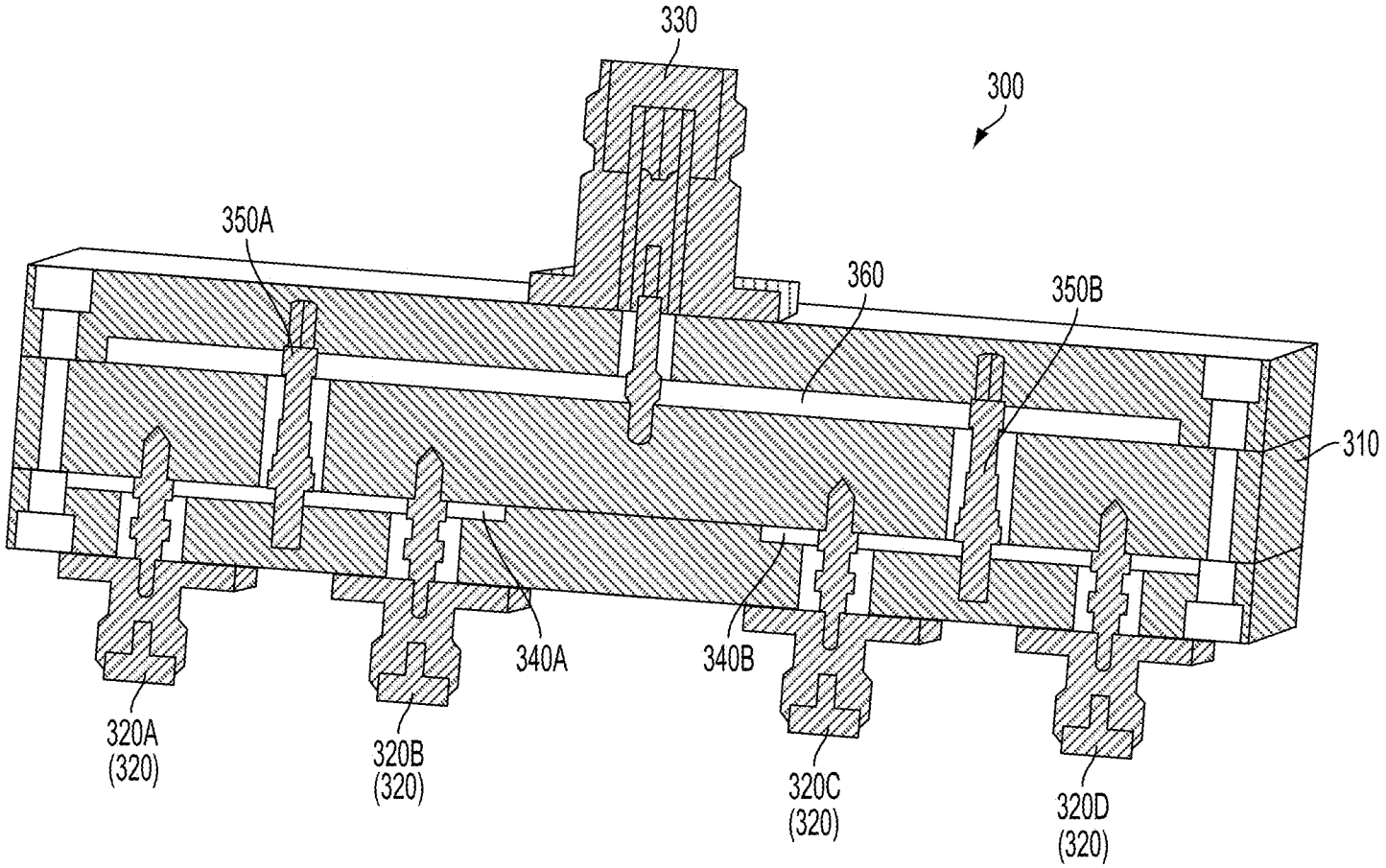
FIG. 2B shows a cross-sectional view of the multi-port combiner of FIG. 2A.

FIG. 2B shows a cross-sectional view of the multi-port combiner 300. As seen, the combiner 300 may include one or more transmission lines 340A, 340B, 340C (individually or collectively referred to as 340). The combiner 300 may further include one or more probes 350A, 350B (individually or collectively referred to as 350).

The transmission lines 340 may include, e.g., a rectangular waveguide, a double-ridged terminated waveguide, a strip-line transmission line, a coaxial transmission line, a micro-strip, a single-wire transmission line, or the like. The rectangular waveguide may include, e.g., a WR-1 waveguide, a WR-1.5 waveguide, a WR-2 waveguide, a WR-3 waveguide, a WR-4 waveguide, a WR-5 waveguide, a WR-6 waveguide, a WR-8 waveguide, a WR-10 waveguide, a WR-12 waveguide, a WR-15 waveguide, a WR-19 waveguide, a WR-22 waveguide, a WR-28 waveguide, a WR-42 waveguide, a WR-51 waveguide, a WR-62 waveguide, a WR-90 waveguide, a WR-112 waveguide, a WR-137 waveguide, or the like.

The probes 350 may include, e.g., coaxial probes. The transmission lines 340 and the loading probes 350 may be stepped impedance matched to make what may appear as an infinite transmission line.

Figure 3:
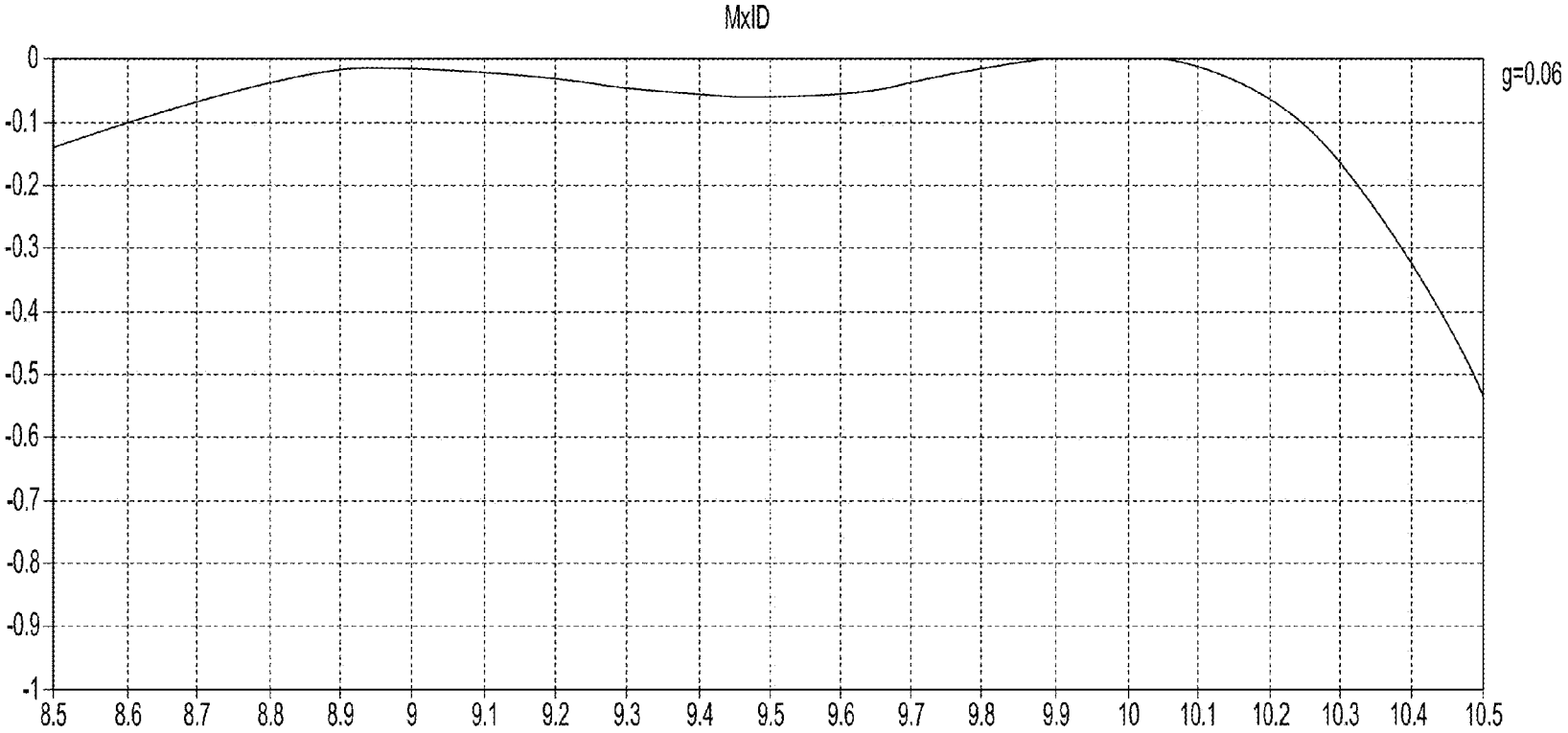
FIG. 3 shows a graph of a combining insertion loss of the multi-port combiner of FIG. 2A over X-band.

FIG. 3 shows a graph of a combining loss of the multi-port combiner 300 over an X-band, including, e.g., a bandwidth of, e.g., about 8.5 GHz to about 10.5 GHz. As seen in the graph, the multi-port 300 provides a relatively constant and low combining loss over the frequency range of about 8.5 GHz to about 10.5 GHz.

Figure 4:
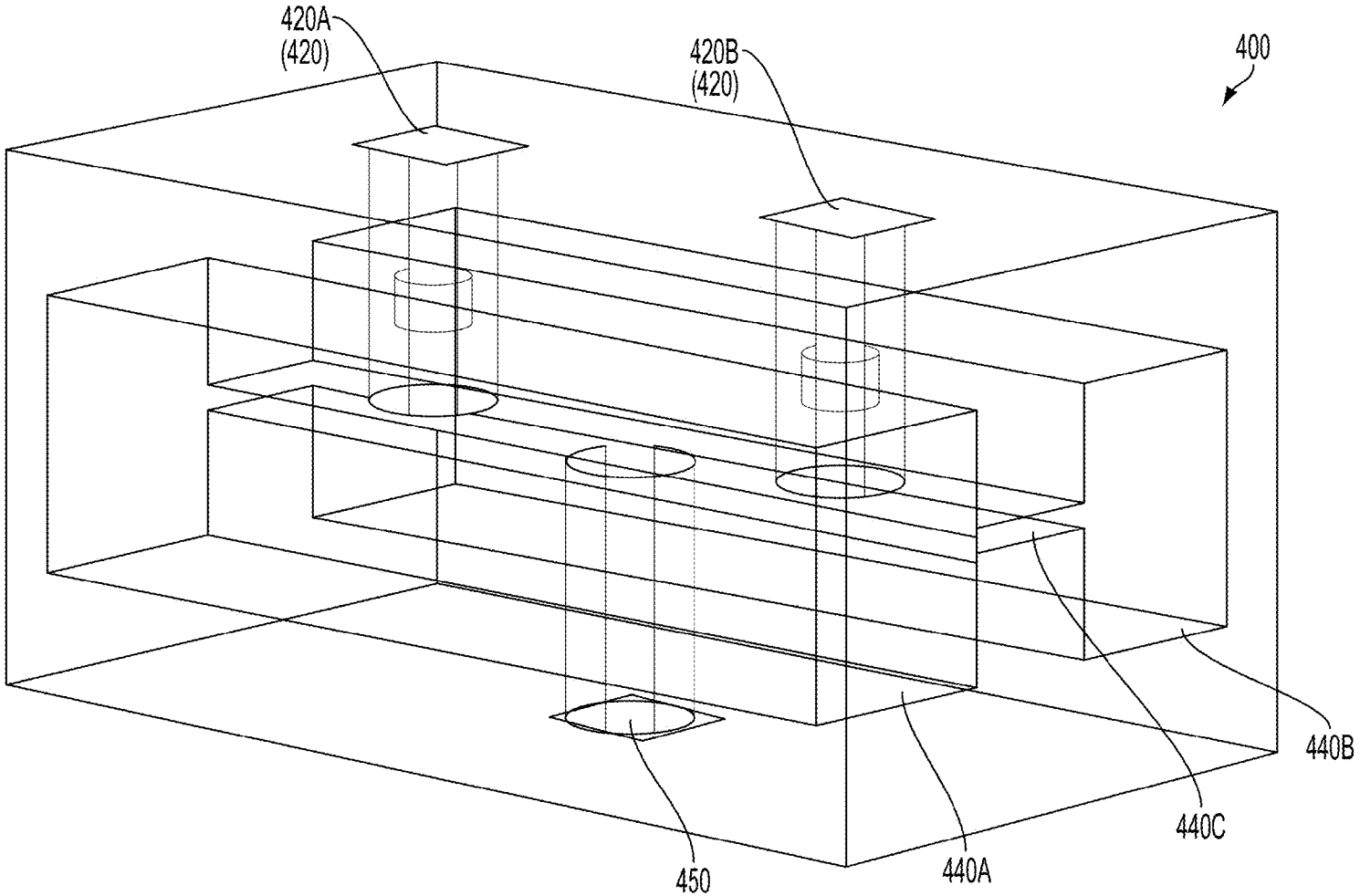
FIG. 4 shows an example of a double-ridge 2-way combiner that is constructed according to the principles of the disclosure.

FIG. 4 shows an example of a 2-way double-ridged combiner 400 that is constructed according to the principles of the disclosure. The combiner 400 comprises a body, a plurality of feeding probes 420A, 420B (individually or collectively referred to as 420), a combining probe 450, and a double-ridged terminated transmission line 440A, 440B, 440C (collectively or individually referred to as 440). The feeding probes 420 may be configured to receive a plurality signals (e.g., two X-band signals) from one or more power sources (not shown). The combiner 400 may combine the plurality of received signals to output a single combined signal. Like the building block portion 200 (shown in FIG. 1B), one or more double-ridged combiners 400 may be included as building blocks to construct an N-way combiner.

Figure 5:
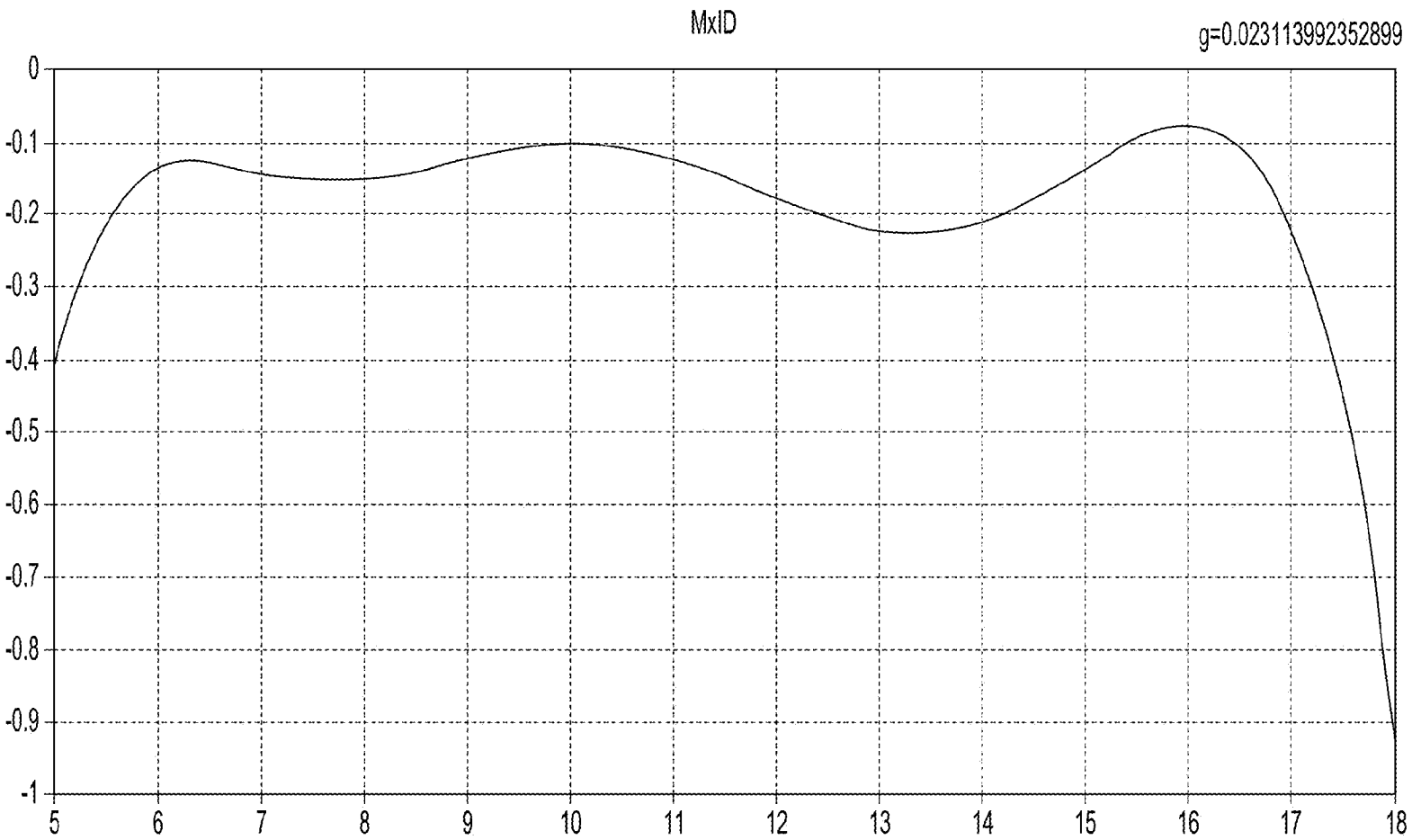
FIG. 5 shows a graph of a combining loss of the double-ridge combiner of FIG. 4.

FIG. 5 shows a graph of a combining loss of the 2-way double-ridge combiner 400. As seen in the graph, the combiner 400 may provide a relatively constant and low combining loss over the frequency range of about 6 GHz to about 17 GHz.

Figure 6:
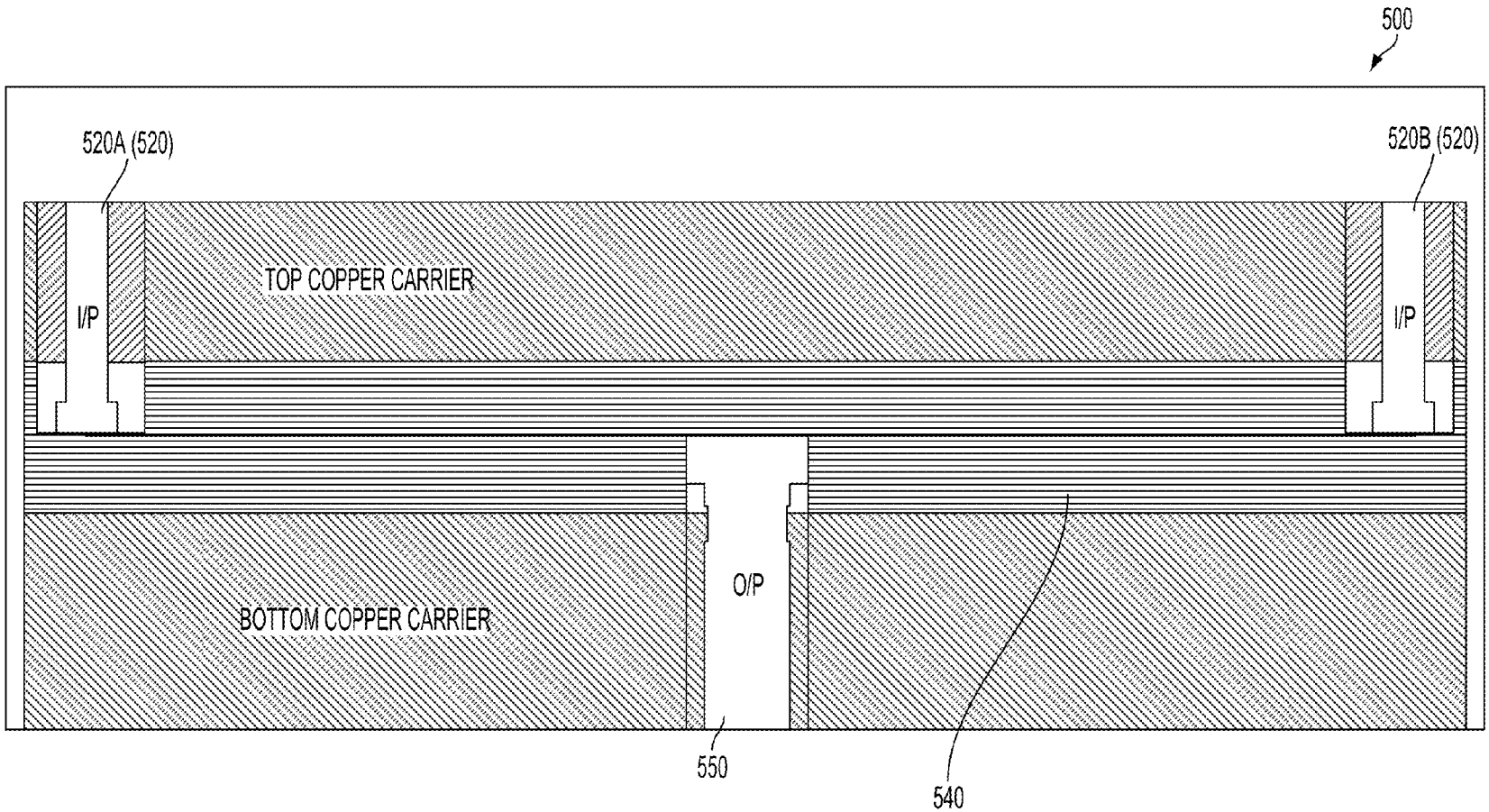
FIG. 6 shows a cross-sectional view of an example of a multi-octave strip-line 2-way combiner that is constructed according to the principles of the disclosure.

FIG. 6 shows a cross-sectional view of an example of a multi-octave 2-way strip-line combiner 500 that is constructed according to the principles of the disclosure. The combiner 500 comprises a body, a plurality of feeding probes 520A, 520B (individually or collectively referred to as 520), a combining probe 550, and a strip-line wave guide portion 540. The body may comprise a top copper carrier portion and a bottom carrier portion, and a double-ridged terminated transmission line. The strip-line wave guide portion 540 may include, e.g., a Roger's material, or the like. The feeding probes 520 may be configured to receive a plurality signals (e.g., two X-band signals) from one or more power sources (not shown) and output a combined signal via the combining probe 550. Like the building block portion 200 (shown in FIG. 1B), one or more combiners 500 may be included as building blocks to construct an N-way combiner.

Figure 7:
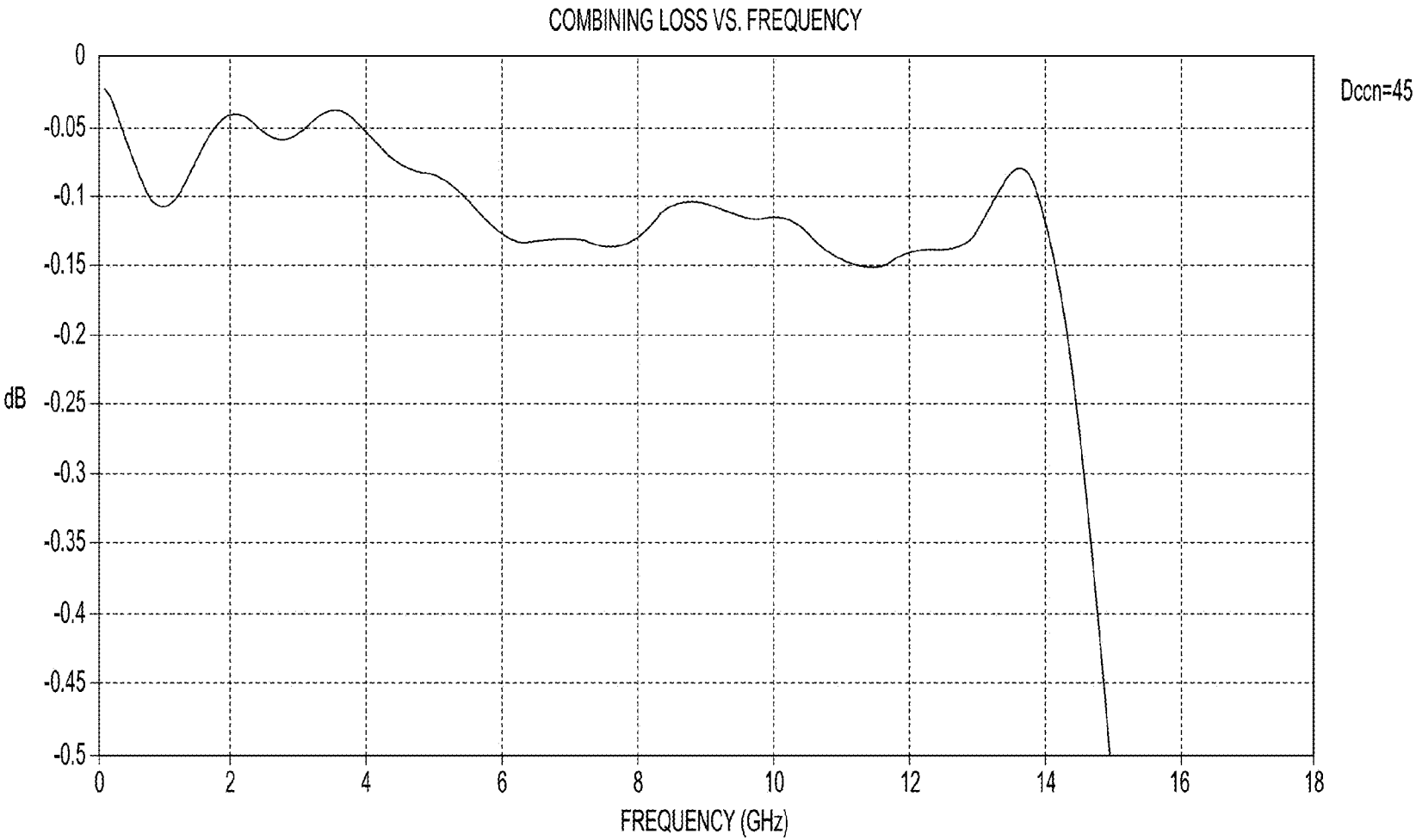
FIG. 7 shows a graph of a combining loss of multi-octave strip-line combiner of FIG. 6.

FIG. 7 shows a graph of a combining loss of the multi-octave 2-way strip-line combiner 500 (shown in FIG. 6). The graph shows the combining loss for the combiner 500 over the frequency range of about 0 GHz to about 15 GHZ. As seen in the graph, the combiner 500 may provide a relatively constant and low combining loss over the frequency range of about 0 GHz to about 14 GHz.

Figure 8A:
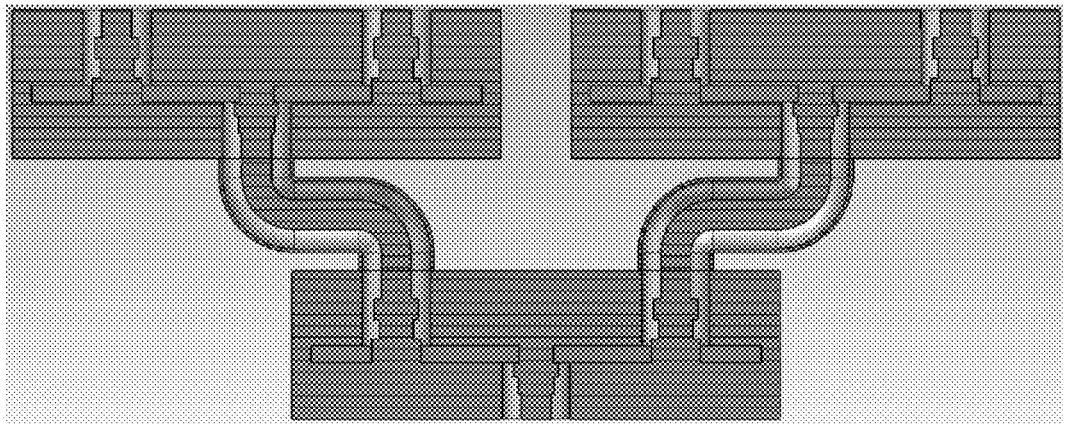
FIGS. 8A and 8B show examples of a 2-way combiner that is connected two 2-way combiners, according to the principles of the disclosure.
Figure 8B:
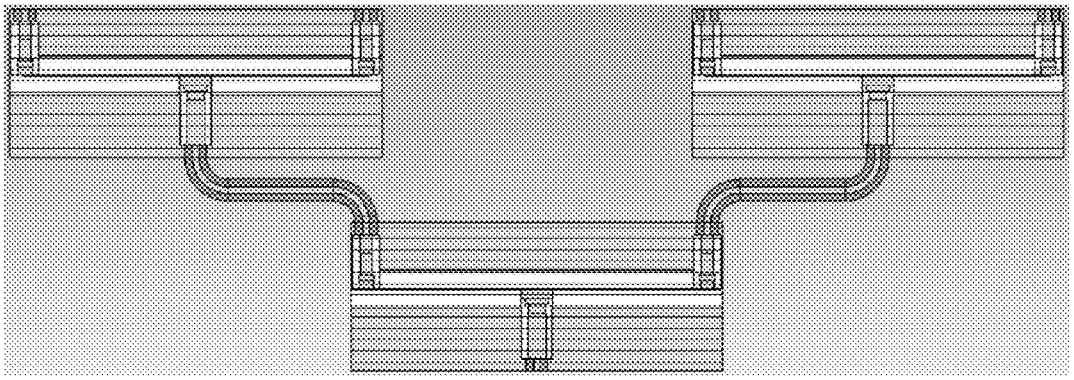

FIGS. 8A and 8B show two separate examples of a 4-way combiner that is constructed from two 2-way combiners connected to a single 2-way combiner, according to the principles of the disclosure. It is noted that the types and numbers of combiners can be selected and mixed-and-matched depending on application, such as, for example, scalability, bandwidth requirements, and the like. For example, a single 4-way combiner may be coupled to a single 2-way combiner where, e.g., smaller dimensions are desired with a narrower bandwidth. Alternatively, the 4-way combiner may be coupled to four 2-way combiners; or the 2-way combiner may be coupled to two 4-way combiners.

According to the principles of the disclosure, a basic building block portion is disclosed herein that may be used to construct N-way combiners, where N=2, 4, 6, 8, . . . . The combiners disclosed herein, as well as those that may be constructed by practicing the principles disclosed herein, provide, among other things, high power, wide bandwidth, high thermal capacity, and low loss, all of which may be provided in a small scale, planar, compact size structure that is capable of providing high power output levels (e.g., 3 KW, or more). The basic building block portions may include high Q resonance, impedance matching, and the like.

Figure 9:
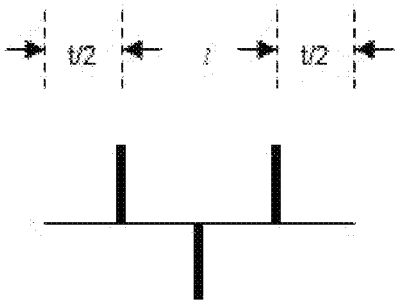
FIG. 9 shows an example of a building block cell of a combiner that is constructed according to the principles of the disclosure.

FIG. 9 shows an example of a building block cell (or portion) that may be used to construct the N-way combiner, according to the principles of the disclosure. The building block cell includes two inputs and a single output with a separation l between the inputs and a total width of t+1.

Figure 10:
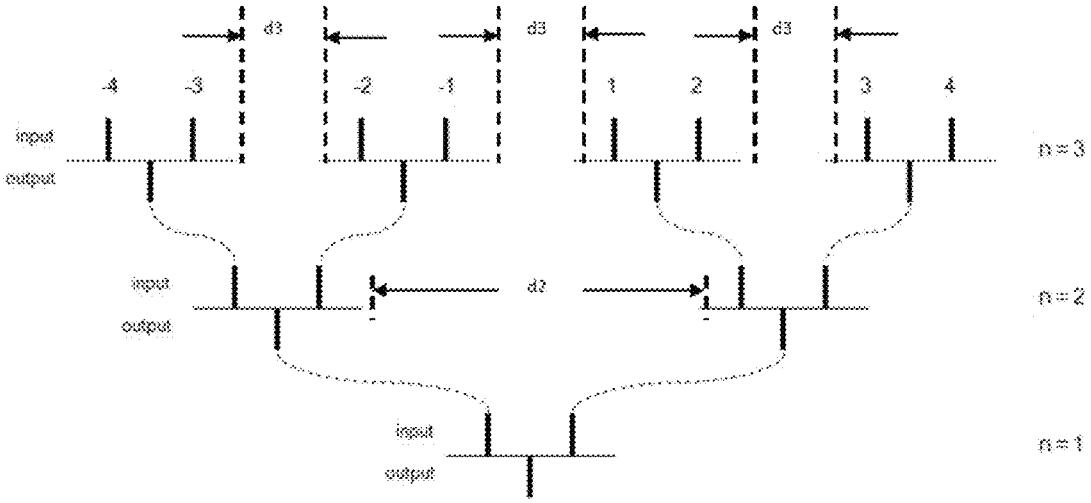
FIG. 10 shows an example of an 8-way combiner that is constructed according to the principles of the disclosure.

FIG. 10 shows an example of a multi-stage combiner, where N=8 (an 8-way combiner), that is constructed according to the principles of the disclosure.

For the general case of an N-way combiner, the maximum level $n_{max}$ may be determined by the following relationship:

$$n_{max}=\ln(N)/\ln(2) \quad [1]$$

where ln(x) is the natural logarithm of the variable x. In the example of FIG. 10, $n_{max}=\ln(8)/\ln(2)=3$. Furthermore, the separations between cells (or portions), denoted by $d_n$, is a linear function of $d_{nmax}$, which is the separation between cells at the maximum $n_{max}$ level.

The longitudinal separation between the various levels in FIG. 10 may be determined by the size of the waveguides connecting the input of one level to the output of another, as well as e.g. the bending radius of curvature of those waveguides. In this regard, the maximum transverse dimension $W_{max}$ of the combiner may be determined by the following relationship:

$$W_{max}=N*(l+t)/2+(N/2-1)*d_{nmax} \quad [2]$$

Referring to the example of the combiner in FIG. 10, the eight input transverse locations $Y^{(n)}_{ipi}$ for the eight inputs i at the level $n=n_{max}=3$, with a symmetry around Y=0, may be obtained as follows:

$$Y^{(3)}_{ip1}=0.5*(t+d_3) \quad [3]$$

$$Y^{(3)}_{ip2}=0.5*(t+d_3)+l \quad [4]$$

$$Y^{(3)}_{ip3}=1.5*(t+d_3)+l \quad [5]$$

$$Y^{(3)}_{ip4}=1.5*(t+d_3)+2*l \quad [6]$$

$$Y^{(3)}_{ip-1}=-Y^{(3)}_{ip1} \quad [7]$$

$$Y^{(3)}_{ip-2}=-Y^{(3)}_{ip2} \quad [8]$$

$$Y^{(3)}_{ip-3}=-Y^{(3)}_{ip3} \quad [9]$$

$$Y^{(3)}_{ip-4}=-Y^{(3)}_{ip4} \quad [10]$$

where N=8 and i=−4, −3, −2, −1, 1, 2, 3, 4.

The four output transverse locations $Y^{(n)}_{opj}$ for the four outputs j at the level $n=n_{max}=3$, with a symmetry around Y=0, may be determined from the following:

$$Y^{(3)}_{op1}=0.5*(t+d_3+l) \quad [11]$$

$$Y^{(3)}_{op2}=1.5*(t+d_3+l) \quad [12]$$

$$Y^{(3)}_{op-1}=-Y^{(3)}_{op1} \quad [13]$$

$$Y^{(3)}_{op-2}=-Y^{(3)}_{op2} \quad [14]$$

where N=8 and j=−2, −1, 1, 2.

The four input transverse locations $Y^{(n)}_{ipk}$ for the four inputs k at the level n=2, with a symmetry around Y=0, may be determined from the following:

$$Y^{(2)}_{ip1}=(t+d_3+l/2) \quad [15]$$

$$Y^{(2)}_{ip2}=(t+d_3+3l/2) \quad [16]$$

$$Y^{(2)}_{ip-1}=-Y^{(2)}_{ip1} \quad [17]$$

$$Y^{(2)}_{ip-2}=-Y^{(2)}_{ip2} \quad [18]$$

where N=8 and k=−2, −1, 1, 2. The separation $d_2$ between cells in the n=2 level may be determined by the following:

$$d_2=t+d_3+2*l \quad [19]$$

where $d_2$ is a linear function of $d_3$ ($d_3=d_{nmax}$).

The two output transverse locations $Y^{(n)}_{opm}$ for the two outputs m at the level n=2, with a symmetry around Y=0, may be determined from the following:

$$Y^{(2)}_{op1}=t+d_3+l \quad [20]$$

$$Y^{(2)}_{op-1}=-Y^{(2)}_{op1} \quad [21]$$

where N=8 and m=−1, 1.

The two input transverse locations $Y^{(n)}_{ipq}$ for the two inputs q at the level n=1, with a symmetry around Y=0, may be determined from the following:

$$Y^{(1)}_{ip1}=l/2 \quad [22]$$

$$Y^{(1)}_{ip-1}=-Y^{(1)}_{ip1} \quad [23]$$

where N=8 and q=−1, 1.

The single output transverse location $Y^{(n)}_{opr}$ for the output r at the level n=1, with a symmetry around Y=0, may be determined from the following:

$$Y^{(1)}_{op1}=0 \quad [24]$$

where N=8 and r=1.

While the disclosure has been described in terms of exemplary embodiments, those skilled in the art will recognize that the disclosure can be practiced with modifications in the spirit and scope of the appended claims. These examples are merely illustrative and are not meant to be an exhaustive list of all possible designs, embodiments, applications or modifications of the disclosure.

What is claimed:

1. A broadband building block portion, comprising:

a first feeding probe that receives a first input signal;

a second feeding probe that receives a second input signal;

a combining probe that combines the first and second input signals to output a combined signal; and an interchangeable transmission line coupled to the first and second feeding probes, wherein the interchangeable transmission line comprises a high Q resonator value, and wherein the combining probe is loaded to reduce an external Q value of the combining probe close to unity.

2. The building block portion of claim 1, wherein the transmission line comprises a terminated transmission line with the first feeding probe at one end and the second feeding probe at another end.

3. The building block portion of claim 1, wherein the combining probe is located substantially at a center of a terminated transmission line.

4. The building block portion of claim 1, wherein the transmission line is selected from a group comprising:

a rectangular waveguide;

a double-ridged terminated waveguide;

a strip-line;

a coaxial line;

a micro-strip; or a single-wire line.

5. The building block portion of claim 4, wherein the rectangular waveguide is selected from a group consisting of: a WR-1 waveguide; a WR-1.5 waveguide; a WR-2 waveguide; a WR-3 waveguide; a WR-4 waveguide; a WR-5 waveguide; a WR-6 waveguide; a WR-8 waveguide; a WR-10 waveguide; a WR-12 waveguide; a WR-15 waveguide; a WR-19 waveguide; a WR-22 waveguide; a WR-28 waveguide; a WR-42 waveguide; a WR-51 waveguide; a WR-62 waveguide; a WR-90 waveguide; a WR-112 waveguide; and a WR-137 waveguide.

6. A combiner comprising the building block portion of claim 1, the combiner further comprising:

a third feeding probe that receives a third input signal;

a fourth feeding probe that receives a fourth input signal;

an other combining probe that combines the third and fourth input signals to output an other combined signal; and an other transmission line coupled to the third and fourth feeding probes.

7. The combiner of claim 6, wherein said other transmission line comprises a terminated transmission line with the third feeding probe at one end and the fourth feeding probe at another end.

8. The combiner of claim 6, further comprising:

an output terminal that outputs a combiner signal, wherein the combiner signal comprises said combined signal and said other combined signal.

9. A planar combiner, comprising:

a plurality of feeding probes that receive a plurality of input signals;

a combining probe that combines the plurality of input signals; and a transmission line that carries the plurality of input signals between the plurality of feeding probes and the combining probe, wherein the transmission line comprises a high Q resonator value, and wherein the combining probe is loaded to reduce an external Q value of the combining probe close to unity.

10. The combiner of claim 9, wherein the transmission line comprises a terminated transmission line with a feeding probe on each end.

11. The combiner of claim 9, wherein the transmission line is selected from a group comprising:

a rectangular waveguide;

a double-ridged terminated waveguide;

a strip-line;

a coaxial line;

a micro-strip; or a single-wire line.

12. The combiner of claim 11, wherein the rectangular waveguide is selected from a group consisting of: a WR-1 waveguide; a WR-1.5 waveguide; a WR-2 waveguide; a WR-3 waveguide; a WR-4 waveguide; a WR-5 waveguide; a WR-6 waveguide; a WR-8 waveguide; a WR-10 waveguide; a WR-12 waveguide; a WR-15 waveguide; a WR-19 waveguide; a WR-22 waveguide; a WR-28 waveguide; a WR-42 waveguide; a WR-51 waveguide; a WR-62 waveguide; a WR-90 waveguide; a WR-112 waveguide; and a WR-137 waveguide.

13. The combiner of claim 9, further comprising:

an output terminal that outputs a combined signal, which comprises the plurality of input signals.

14. The combiner of claim 13, wherein the output terminal is connected to the combining probe.

15. The combiner of claim 9, further comprising: a plurality of input terminals connected to the plurality of feeding probes, wherein the plurality of input terminals are configured to receive the plurality of input signals from one or more signal sources.

16. The combiner of claim 9, wherein the plurality of feeding probes comprises two feeding probes.

17. The combiner of claim 9, further comprising: an other combining probe that combines another plurality of input signals.

18. The combiner of claim 17, further comprising:

an other transmission line coupled to the combining probe and said other combining probe.

19. The combiner of claim 18, further comprising:

a further combining probe that is coupled to said other transmission line.

20. The combiner of claim 9, further comprising:

a layer that includes a plurality of through-holes, wherein at least a portion of each of the plurality of feeding probes extends into or through a portion of the layer.

21. The combiner of claim 20, further comprising:

an other layer formed proximate to said layer, wherein at least a portion of the combining probe extends into or through a portion of said other layer, and wherein at least a portion of the transmission line is located between said layer and said other layer.

22. The combiner of claim 21, further comprising:

a further transmission line coupled between a pair of feeding probes, wherein the plurality of probes comprise said pair of feeding probes.

* * * * *